US005924900A

United States Patent [19]

Davis et al.

[11] Patent Number: 5,924,900

[45] Date of Patent: Jul. 20, 1999

[54] CONTACT WITH LATCH FOR CONTACT RETENTION AND HOUSING THEREFOR

[75] Inventors: Wayne Samuel Davis, Harrisburg; Robert Neil Whiteman, Jr., Middletown, both of Pa.

[73] Assignee: The Whitaker Corporation, Wilmington, Del.

[21] Appl. No.: 08/969,293

[22] Filed: Nov. 13, 1997

Related U.S. Application Data

[62] Division of application No. 08/741,326, Oct. 29, 1996, abandoned.

[51] Int. Cl.[6] ..... H01R 13/432

[52] U.S. Cl. ..... 439/748

[58] Field of Search ..... 439/746–749, 439/871

[56] References Cited

U.S. PATENT DOCUMENTS

| | | | |
|---|---|---|---|
| 3,083,345 | 3/1963 | Scheller | 339/47 |
| 3,425,029 | 1/1969 | Zak | 339/252 |
| 3,513,438 | 5/1970 | Henschen et al. | 439/746 |
| 3,550,067 | 12/1970 | Hansen | 439/748 |
| 3,613,052 | 10/1971 | Maltais | 339/217 S |
| 4,046,450 | 9/1977 | Yurtin | 439/746 |
| 4,472,017 | 9/1984 | Sian | 439/747 |
| 4,781,628 | 11/1988 | Detter et al. | 439/748 |
| 4,952,169 | 8/1990 | Hayes, Sr. | 439/403 |
| 5,266,056 | 11/1993 | Baderschneider et al. | 439/745 |
| 5,354,218 | 10/1994 | Pry et al. | 439/595 |
| 5,362,260 | 11/1994 | Peloza | 439/746 |
| 5,435,754 | 7/1995 | Hotea et al. | 439/620 |

FOREIGN PATENT DOCUMENTS

| | | |
|---|---|---|
| 0043200 A1 | 1/1982 | European Pat. Off. . |
| 0 197 642 | 10/1986 | European Pat. Off. . |
| 27 33 229 | 2/1978 | Germany . |
| 2024538 | 11/1978 | United Kingdom . |

OTHER PUBLICATIONS

*AMP Drawing 770642*, "Terminal, Timer Connector", one page; (1991); AMP Incorporated, Harrisburg, PA.

*AMP Information Sheet IS 9514*, "AMP Extraction Tool . . . for AMP Timer Terminals . . . ", two pages; (1991); AMP Incorporated, Harrisburg, PA.

*AMP Drawing 770197*, "Timer Connector Housing, 24 Circuit, Right Hand", one page; (1985); AMP Incorporated, Harrisburg, PA.

*Primary Examiner*—Gary Paumen
*Attorney, Agent, or Firm*—Anton P. Ness

[57] ABSTRACT

Contact (10) including at least one latching arm (50,52) extending rearwardly from a forward end (26) of a socket contact section (12) to define a rearwardly facing latching surface (60) at a free end (56) thereof, for retention of the contact in a housing passageway (72). A single latching arm (108) may be oriented edgewise with respect to the contact-receiving channel and be deflected laterally during insertion, or a pair of such latching arms (50,52;206,208) coextend rearwardly for free ends thereof to be deflected toward each other during insertion. A single latching arm (320) may be oriented parallel to the bottom wall and extend to a free end (324) having side portions (326) bent up to be oriented edgewise and be deflected into the contact-receiving channel (328) during insertion.

8 Claims, 7 Drawing Sheets

CONTACT WITH LATCH FOR CONTACT RETENTION AND HOUSING THEREFOR

This application is a Divisional of application Ser. No. 08/741,326 filed Oct. 29, 1996 now abandoned.

FIELD OF THE INVENTION

This relates to the field of electrical connectors and more particularly to contact terminals insertable into housings.

BACKGROUND OF THE INVENTION

Contacts insertable into passageways of housings require assured mechanisms to be retained in the passageways after insertion, resistant to strain. Stamped and formed contacts commonly rely on lances cooperating with ledges along one or more walls of the passageway to resist withdrawal in a direction opposed to the direction of insertion, and the lances commonly are deflectable during insertion until passing the ledge whereafter the lances resile for a free end thereof to abut the ledge to define a positive stop.

One such contact is disclosed in U.S. Pat. No. 5,362,260, wherein the contact is stamped and formed from a metal blank to define a female contact section at one end and a U-shaped channel between upstanding walls at the other end for being crimped around an end of a conductor wire, after which the contact is insertable into a housing passageway. The female contact section is formed from walls of the blank being formed upwardly from a common bottom wall to form side walls and then a pair of top wall sections extending toward each other from top edges of the side walls, the female contact section having a box shape defining a contact-receiving channel. A pair of spring contact arms is formed into the top wall sections, each extending between joints with leading and trailing end portions of respective top wall sections, and spring contact portions between the joints protruding into the contact-receiving channel. Opposed side edges of the original blank side walls are stamped into struts joined at their ends to the leading end portions of respective top wall sections and to flexible tabs spaced rearwardly of the trailing top wall end portions, extending the length of the female contact section and oriented laterally outwardly from the contact-receiving channel, with top edges sloping slightly upwardly from front to rear. Rearward edges of each strut define rearwardly facing stop surfaces cooperable with ledges of the housing passageway after full insertion for contact retention, while during insertion the supported struts are controllably deflectable at least at the rearward ends into the contact-receiving channel by a constriction of the passageway rearwardly of the ledge.

Other latching mechanisms are known, such as one where a latching projection extends into the housing passageway from a side wall and seats within an aperture of a portion of the contact upon full insertion; the socket contact section comprises a pair of contact spring arms coextending along the bottom wall of contact-receiving channel and a second pair along the top wall, with both ends of all the arms joined integrally with the bottom and top walls. Such a contact is Part No. 770642-1 sold by AMP Incorporated.

It is desired to provide an assured latching system for retention of a female contact upon full insertion into a housing passageway, with the latching mechanism formed integral with the contact stamped and formed from a common blank and with no interference with the spring beams of the contact during assembly or during mating.

It is also desired to provide a latching system that permits ease of contact insertion during assembly and yet establishes substantial resistance to withdrawal after assembly.

SUMMARY OF THE INVENTION

The present invention provides at least one latching arm extending rearwardly from a leading edge of a socket contact section of a stamped and formed contact to a free end defining a rearwardly facing latching surface on an edge oriented outwardly from the contact-receiving channel of the socket contact section, such that the latching arm is deflectable during insertion of the contact in a housing passageway and prior to seating. The latching arm or arms are formed from a portion of the blank in a manner that permits a pair of contact spring arms to be formed along the top of the socket contact section with both ends of the spring arms joined to the top wall with no interference to deflection of the latch arm or arms therebeside during contact insertion, and with no interference by the latching arm or arms with the deflection of the contact spring arms during mating.

In one embodiment a pair of elongate latching arms are formed along opposed side edges of the wall of the blank from which the socket contact section is stamped, and extend rearwardly from a leading edge of the blank to respective free ends. Upon full forming the latching arms are edgewise to the socket contact section and their free ends are deflectable toward each other during insertion into the housing passageway through a narrow slot leading to the forwardly facing latching ledge after which they resile to seat along the ledge to latch. In a preferred embodiment, the contact includes structure that restrains the free ends of the latching arms to prevent overstress and damage.

In another embodiment, a single such latch arm is formed along one of the side edges of the blank wall extending rearwardly from the blank leading edge to a free end defining the latching surface, with the free end again being deflectable laterally during insertion.

In an additional embodiment, a latching arm is disposed in a plane oriented parallel to the contact-receiving channel and extends rearwardly from the contact leading edge to a free end, where the free end includes a pair of short side walls along side edges thereof, each upstanding to coextend outwardly from the contact-receiving channel with the rearward edges of the side walls comprising the latching surfaces; the latching arm extends rearwardly between the pair of contact spring arms along the top wall, preferably extending beneath a trailing end top wall portion, and is deflectable inwardly into the contact-receiving channel until seated.

Embodiments of the present invention will now be described by way of example with reference to the accompanying drawings.

DETAILED DESCRIPTION

Figure 9:
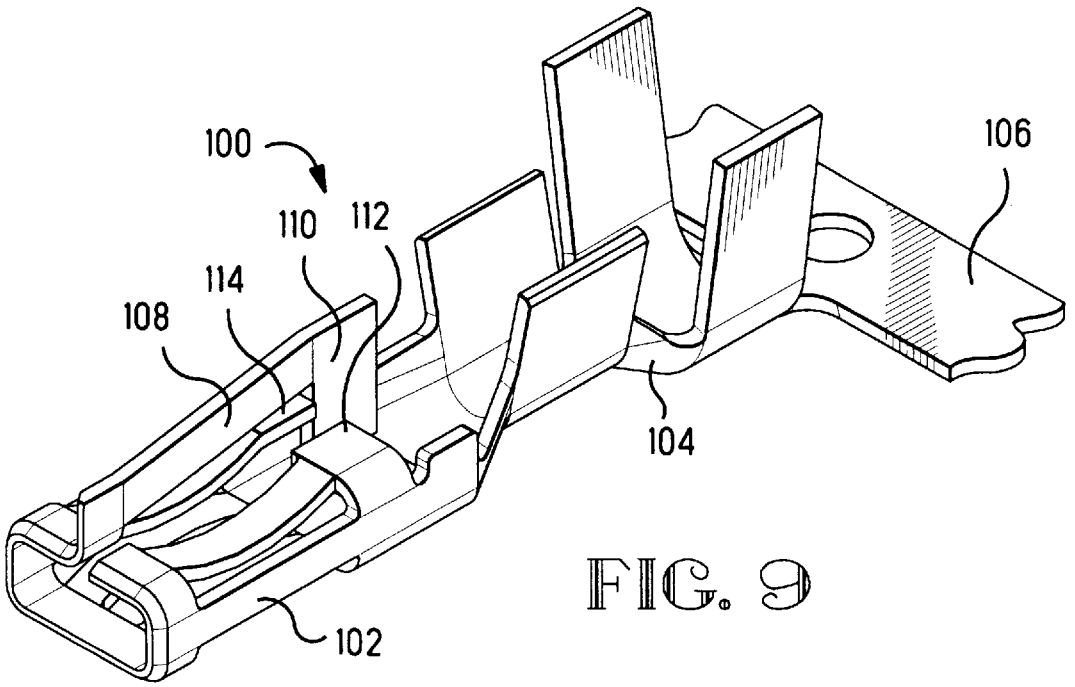
FIGS. 9 and 10 illustrate a second embodiment of the contact of the present invention for use with a housing passageway similar to that of FIG. 2.
Figure 10:
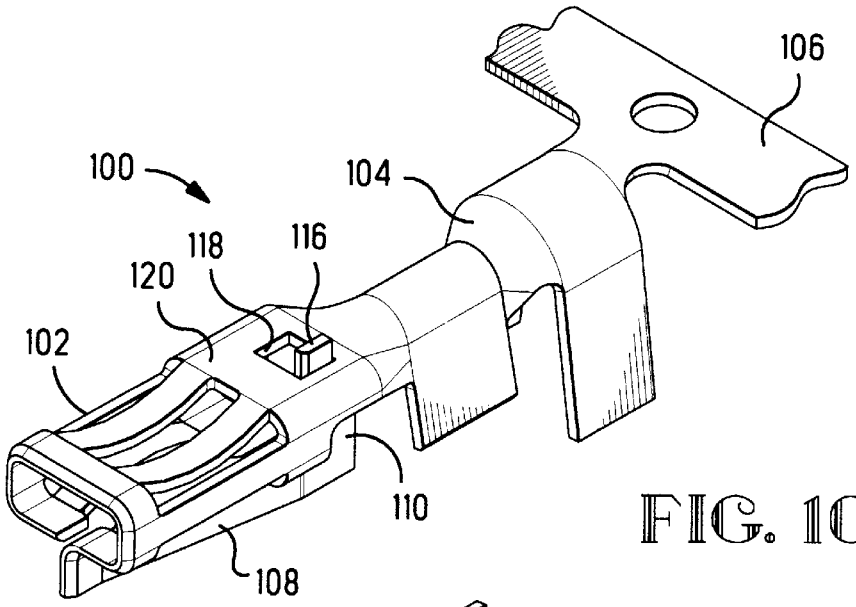
Figure 11:
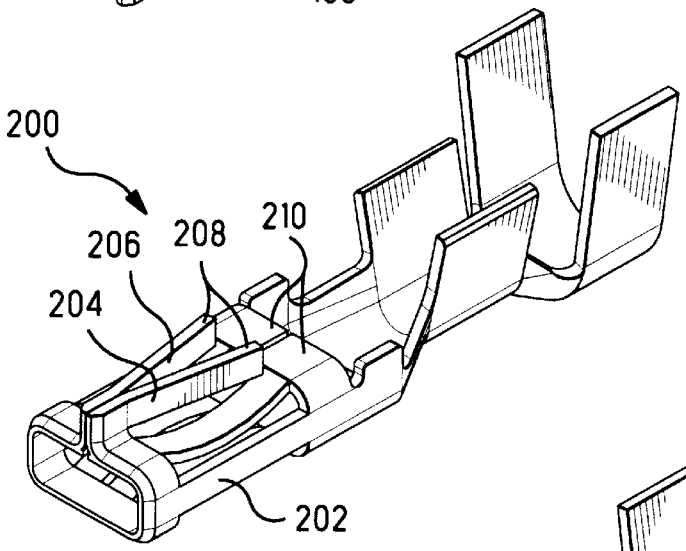
FIG. 11 is an isometric view of a third embodiment similar to those of FIGS. 1 to 10.
Figure 12:
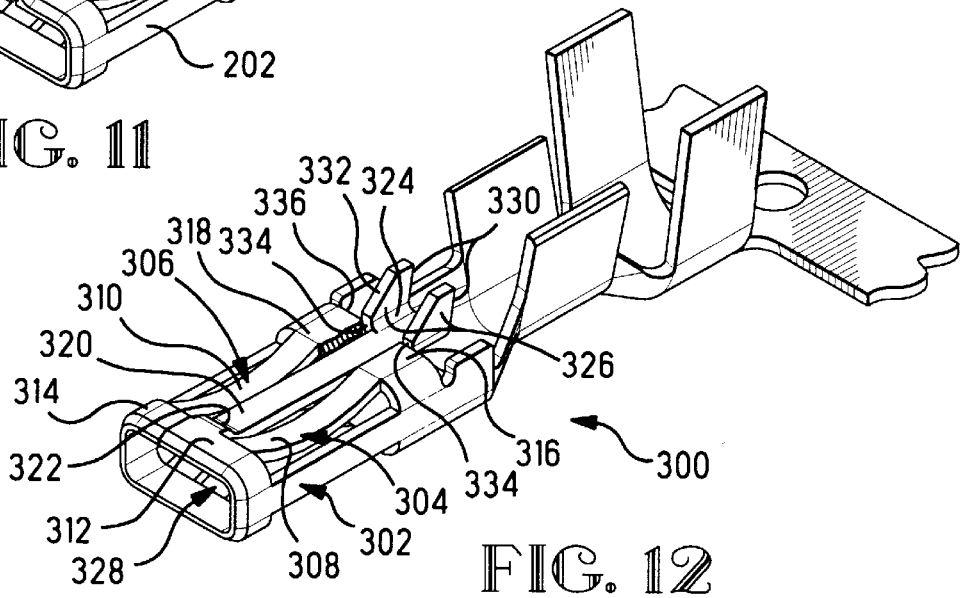
FIG. 12 is a partially broken away isometric view of a fourth embodiment of contact.
Figure 13:
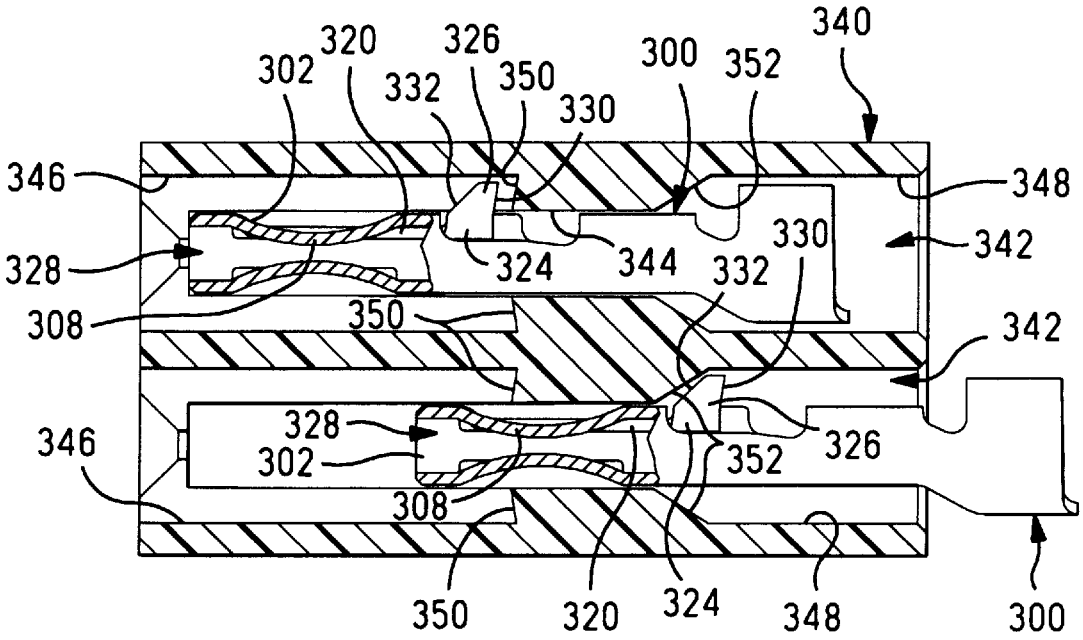
FIG. 13 is an elevation section view of a housing with a contact of FIG. 12 partially inserted into a first passageway and another fully inserted into a second passageway.
Figure 14:
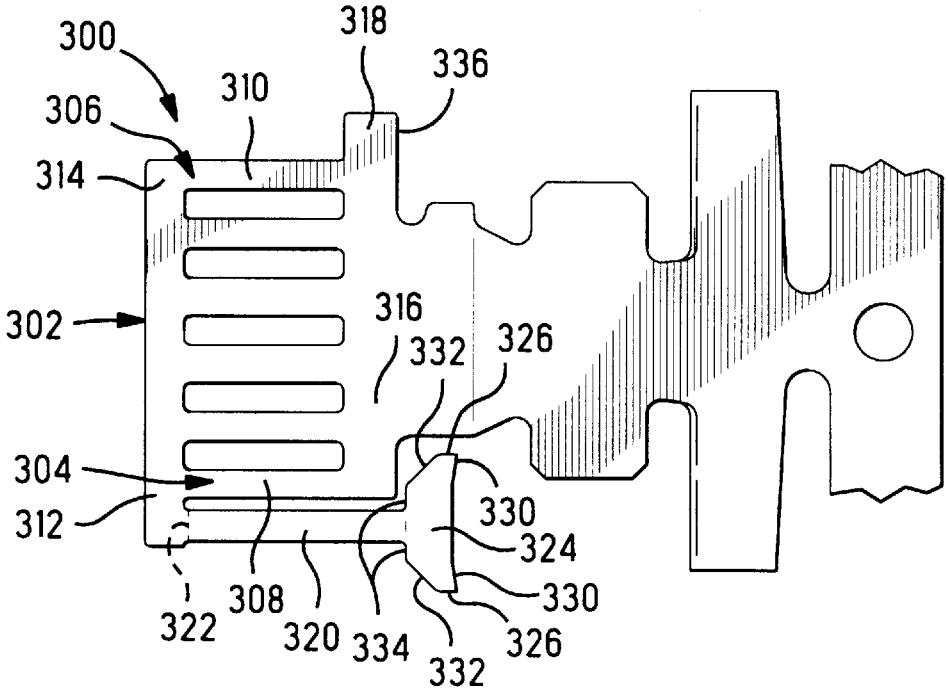
FIG. 14 is a plan view of a blank of the contact of FIGS. 12 and 13 prior to forming.

The contact member of the present invention is to be stamped and formed from a single blank and define a latching arm adjacent the socket contact section at the forward end. A first embodiment of contact, and a corresponding housing passageway, is illustrated in FIGS. 1 to 8; a second embodiment similar to the first is shown in FIGS. 9 and 10; a third embodiment is shown in FIG. 11; and a fourth embodiment of contact is shown in FIGS. 12 to 14, along with a complementary housing passageway. In all the embodiments, the socket contact section is disclosed to be of a generally rectangular type in cross-section, defining a rectangular contact-receiving channel and having a pair of contact spring arms along the top wall opposing a pair of contact spring arms along the bottom wall.

Contact 10 of FIGS. 1 to 8 includes a socket contact section 12 having bottom wall 14, side walls 16,18 and top wall sections 20,22 therebetween defining a contact-receiving channel 24 extending rearwardly from a forward end 26. Rearwardly of socket contact section 12 is body section 28 concluding in a connection section 30, shown adapted for being crimped onto a wire 32 (FIG. 6) in a conventional manner. Socket contact section 12 includes a pair of contact spring arms 34,36 along respective top wall sections 20,22 and joined integrally to leading top wall portions 38 and trailing top wall portions 40. Contact 10 is similar to Part No.770642-1 for use with, for example, a housing having Part No. 770197-1, both sold by AMP Incorporated, Harrisburg, Pa.

Housing 70 is shown in FIGS. 2 to 6 for use with contact member 10, and together they define an electrical connector. Housing 70, best seen in FIG. 2, includes a passageway 72 extending forwardly from insertion face 74 to a contact-receiving entrance 76 along mating face 78 having chamfered surfaces forming a conventional lead-in to facilitate mating. Forward passageway portion 80 is dimensioned to maintain the socket contact section 12 accurately positioned with respect to contact-receiving entrance 76 to align contact-receiving channel 24 therewith. Rearward passageway portion 82 includes angled camming surfaces 84,86 for centering the contact leading end to pass through vertically constricted central passageway portion 88 for eventual positioning of socket contact section 12 in forward passageway portion 80. After full contact insertion, contact body section 28 will reside in central portion 86, and connecting section 30 terminated onto an end of wire 32 will reside in rearward portion 82 which is enlarged to permit use of the contact and housing with cables of varying diameters.

In accordance with the present invention, a pair of latching arms 50,52 are provided along the top wall sections 20,22 of socket contact section 12. Leading ends 54 of latching arms 50,52 are joined to leading top wall portions 38 and extend rearwardly to free ends 56. Trailing edges of free ends 56 define latching surfaces 60 that are associated with forwardly facing latching ledges 90 along the top wall of housing passageway 72. The latching arms are in respective planes oriented to extend outwardly away from contact-receiving channel 24 and outwardly of top wall portions 20,22, with the free ends also being oriented to extend away from contact-receiving channel 24. Preferably latching arms 50,52 are angled as they extend rearwardly from their respective leading ends 54 adjacent each other, so that free ends 56 are spaced apart.

Figure 2:
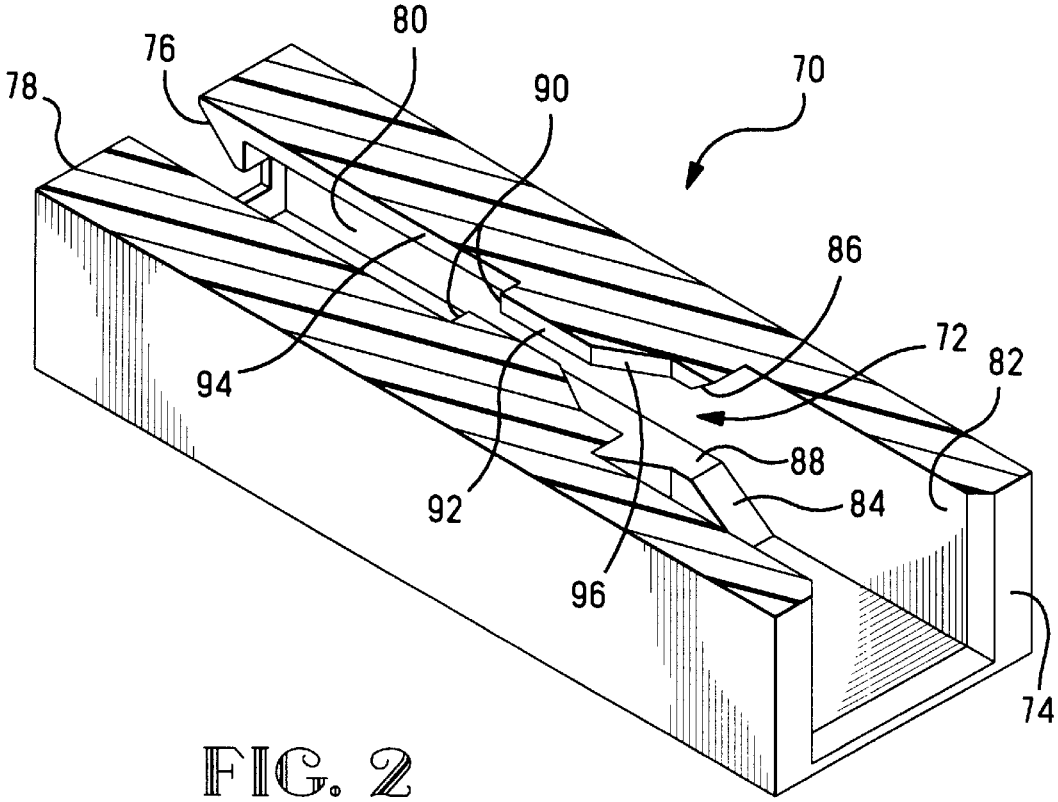
FIG. 2 is a partially sectioned isometric view of the housing passageway useful with the contact of FIG. 1.
Figure 3:
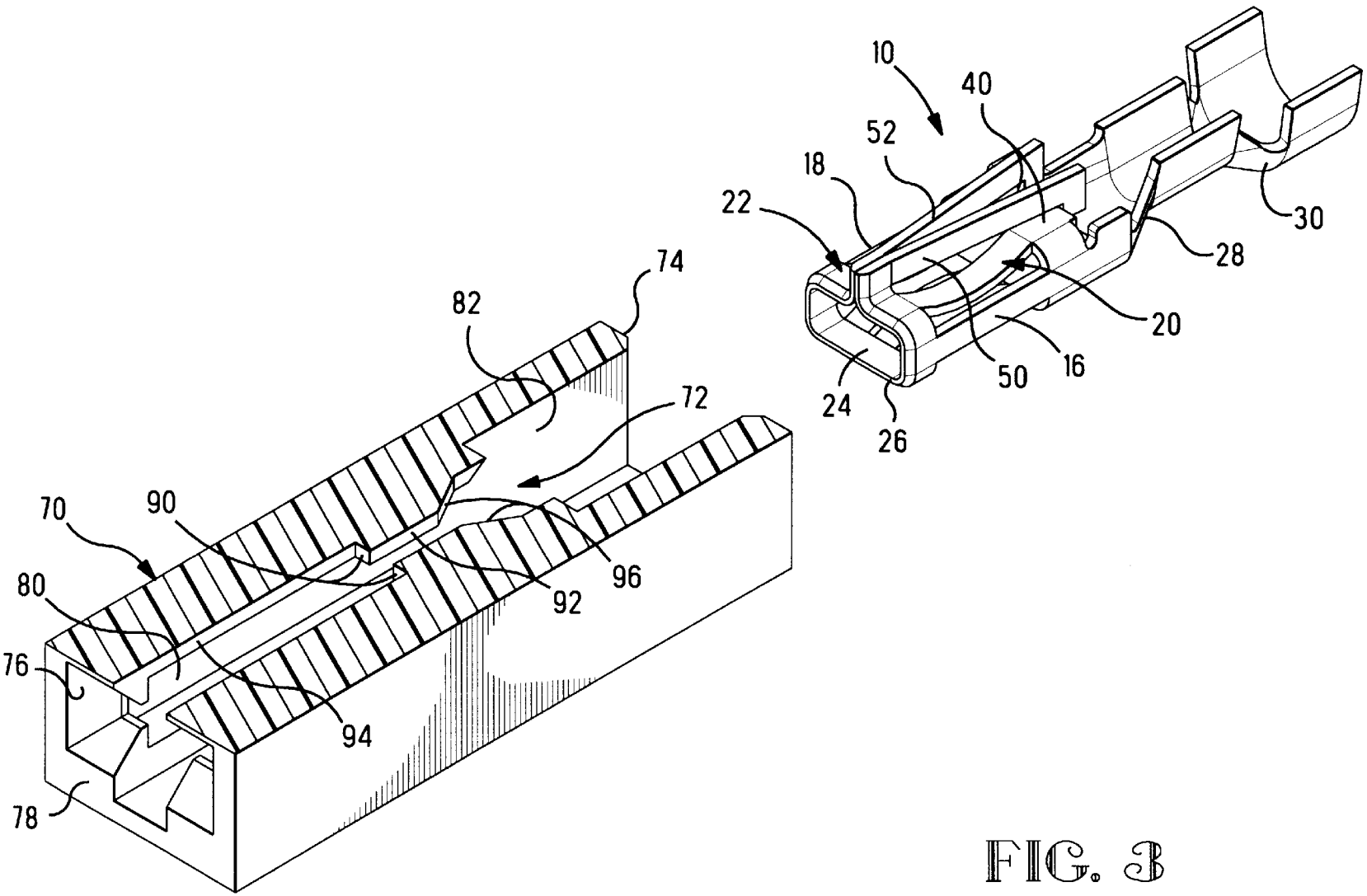
FIGS. 3 and 4 are exploded and assembled views of the contact and housing of FIGS. 1 and 2 from forwardly thereof.
Figure 4:
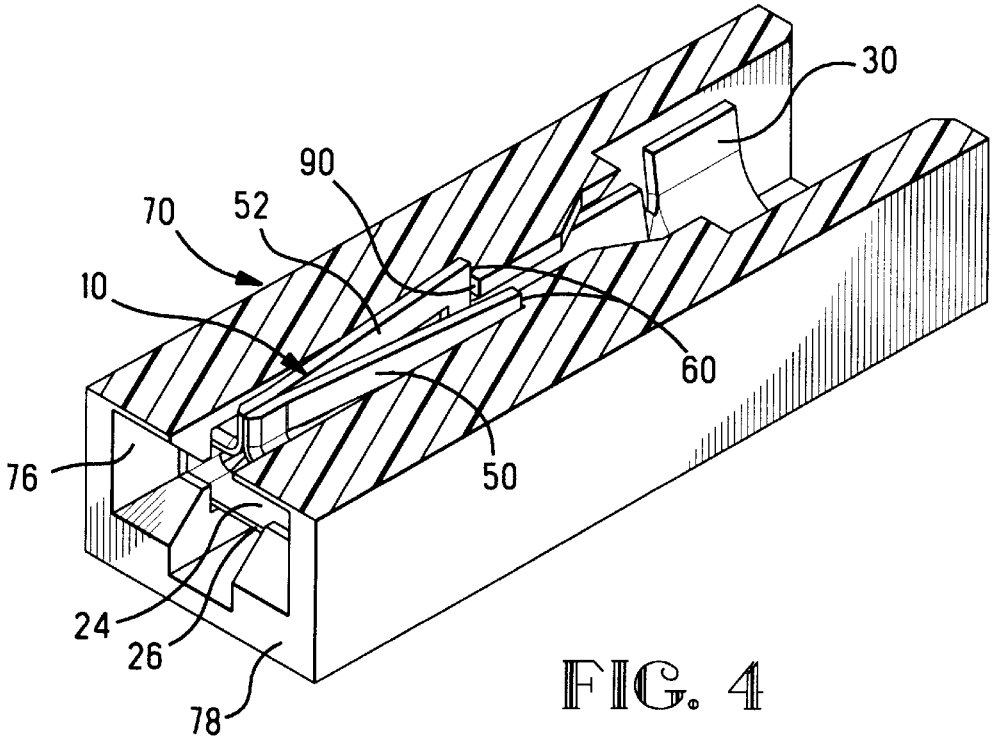
Figure 5:
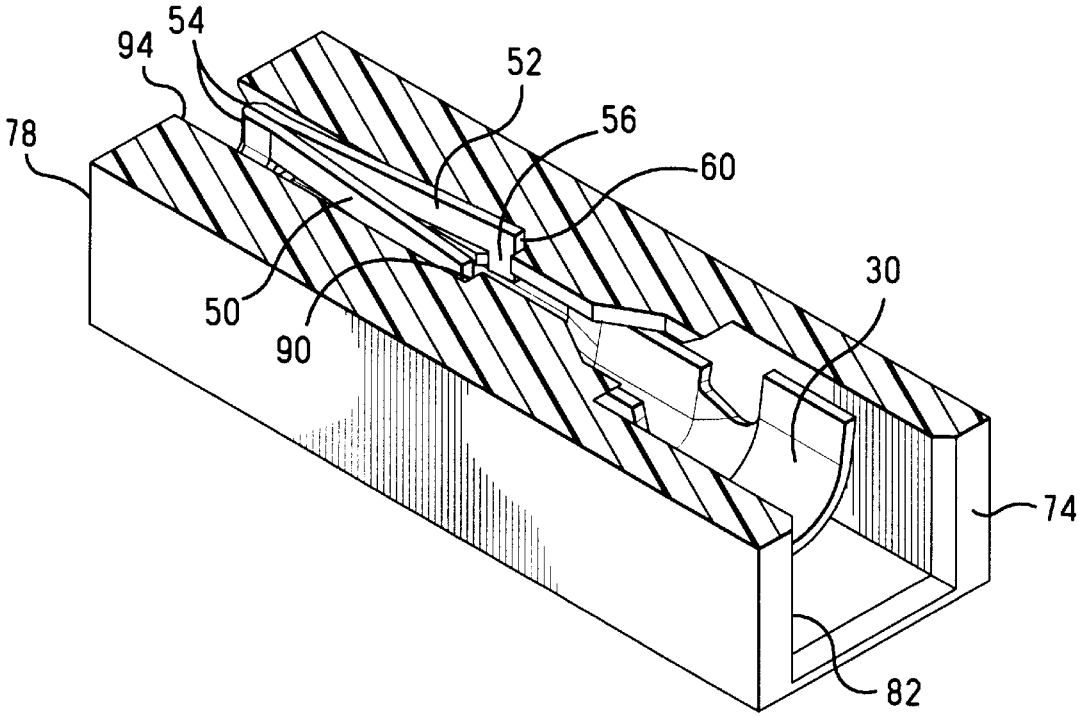
FIGS. 5 and 6 are isometric and plan views of the assembly of FIG. 4.
Figure 6:
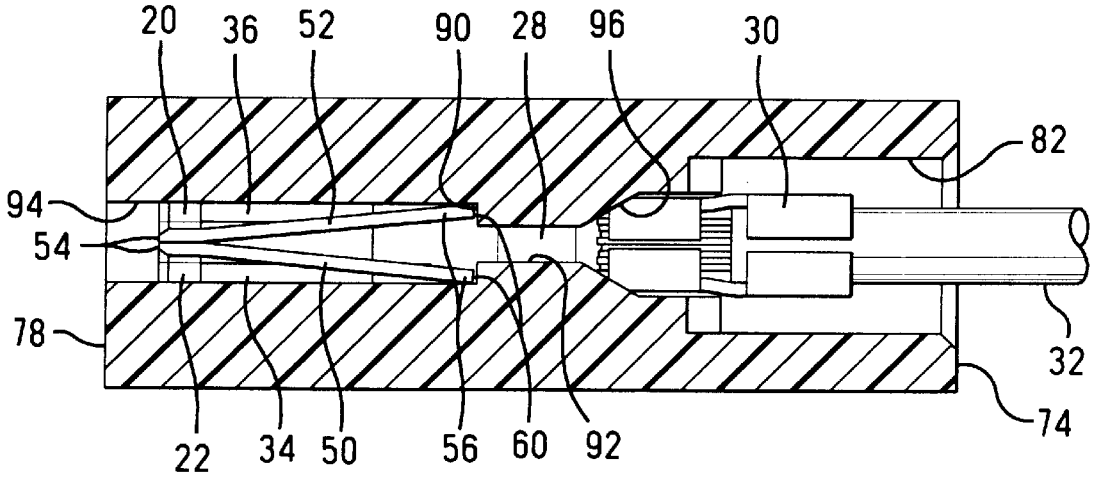

With reference to FIGS. 2 to 4, as contact 10 initially enters into passageway 72 during insertion, leading end 26 of socket contact section 12 engages angled camming surfaces 84,86 and becomes centered vertically in passageway 72 and leading ends of latch arms 50,52 extend upwardly between upper camming surfaces 86. A slot portion 92 is formed through the vertically constricted central passageway portion 86 and extends from forward passageway portion 80 at latching ledges 90 to rearward portion 82, through which pass the latching arms until latching arms 50,52 become positioned in latch arm pocket 94 adjacent forward passageway portion 80 forwardly of latching ledges 90. Angled surfaces 96 are formed at the trailing end of slot portion 92 to center the leading ends 54 of the latching arms with the slot portion for entry thereinto. As latching arms 50,52 pass along slot portion 92, they bear against angled surfaces 96 and become deflected toward each other so that free ends 56 may pass through the slot portion, whereafter they resile positioning latching surfaces 60 axially forwardly of latching ledges 90 upon full contact insertion, as seen in FIGS. 5 and 6. Preferably, slot portions 92, latch arm pockets 94 and latching ledges 90 are formed into both the top and bottom surfaces of the housing passageway to accept a contact 10 in an inverted orientation from that shown in the drawings.

Figure 1:
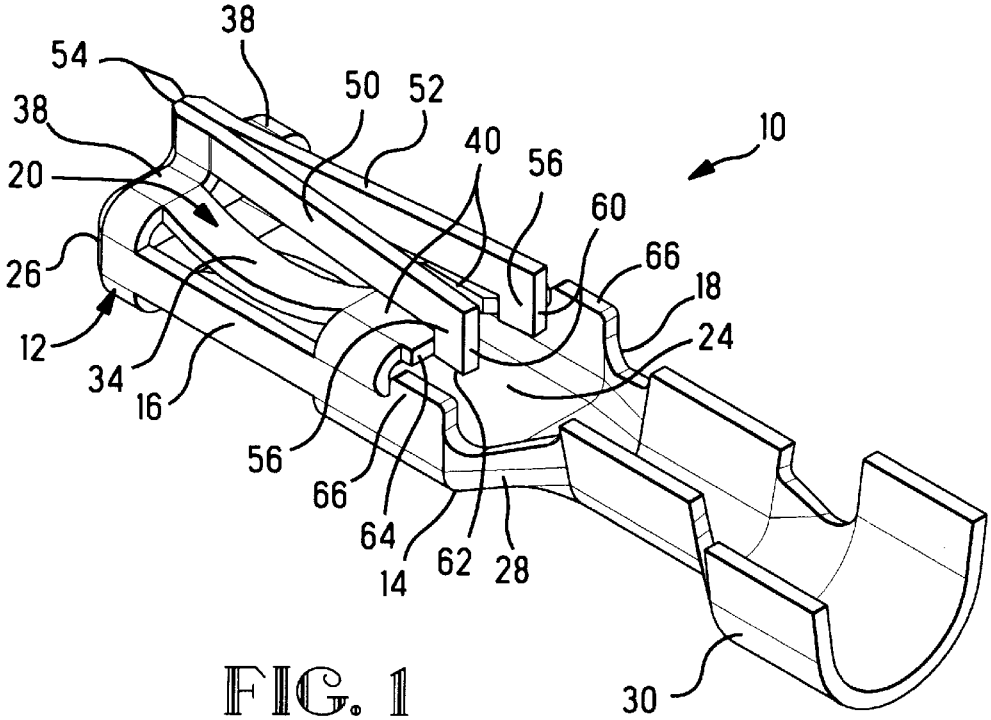
FIG. 1 is an isometric view of the contact of a first embodiment of the present invention.
Figure 7:
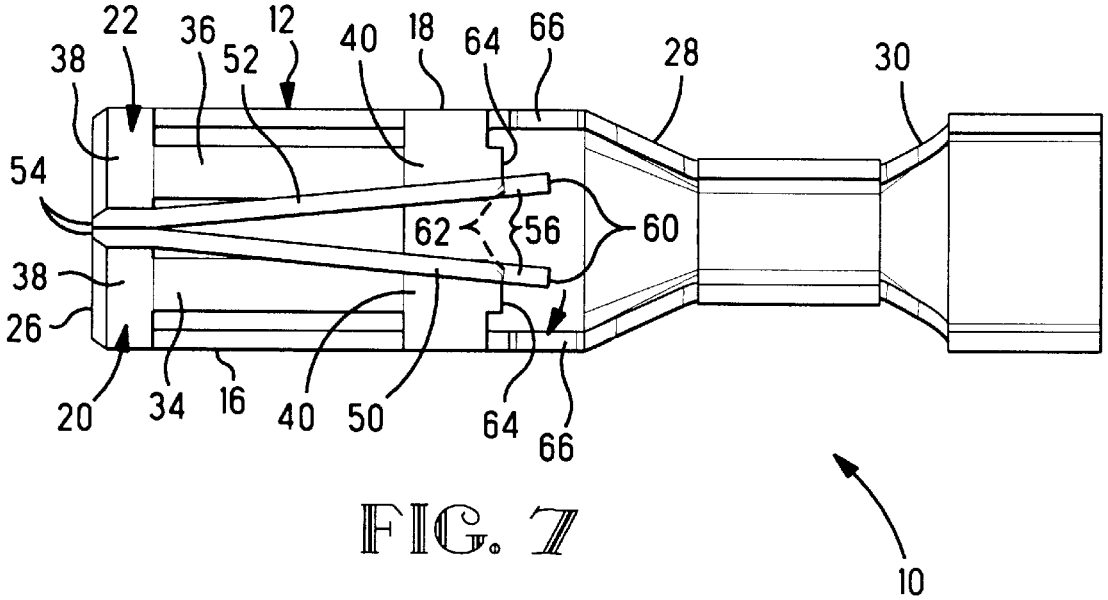
FIG. 7 is a plan view of the contact of FIGS. 1 to 6.

It is seen in FIGS. 1 and 7 that latching arm free ends 56 include tabs 62 depending therefrom extending toward contact-receiving channel 24 just rearwardly of rear edges 64 of rearward top wall portions 40, and inwardly of and between flanges 66 extending upwardly from side walls 16,18. It can be seen that were a latching arm to be rotated outwardly, tab 62 thereof would abut an adjacent rear edge 64 and/or would abut an adjacent flange 66 to positively stop further rotation. In addition to the side walls of the latch arm pocket of the passageway preventing outward rotation of the latching arms after assembly, the inherent antioverstress protection provided by the first embodiment of FIGS. 1 to 8 of the present invention prevents buckling of the latching arms upon substantial strain applied on the cable, as the latching edges of the arms become pressed against the latching ledges, tending to rotate the latching arms outwardly. This arrangement also maintains free ends 56 positively captured between the side walls of the contact prior to insertion of contact 10 for protection against damage and stress, when handling may inadvertently stress the latching arms protruding beyond the top of the socket contact section.

Figure 8:
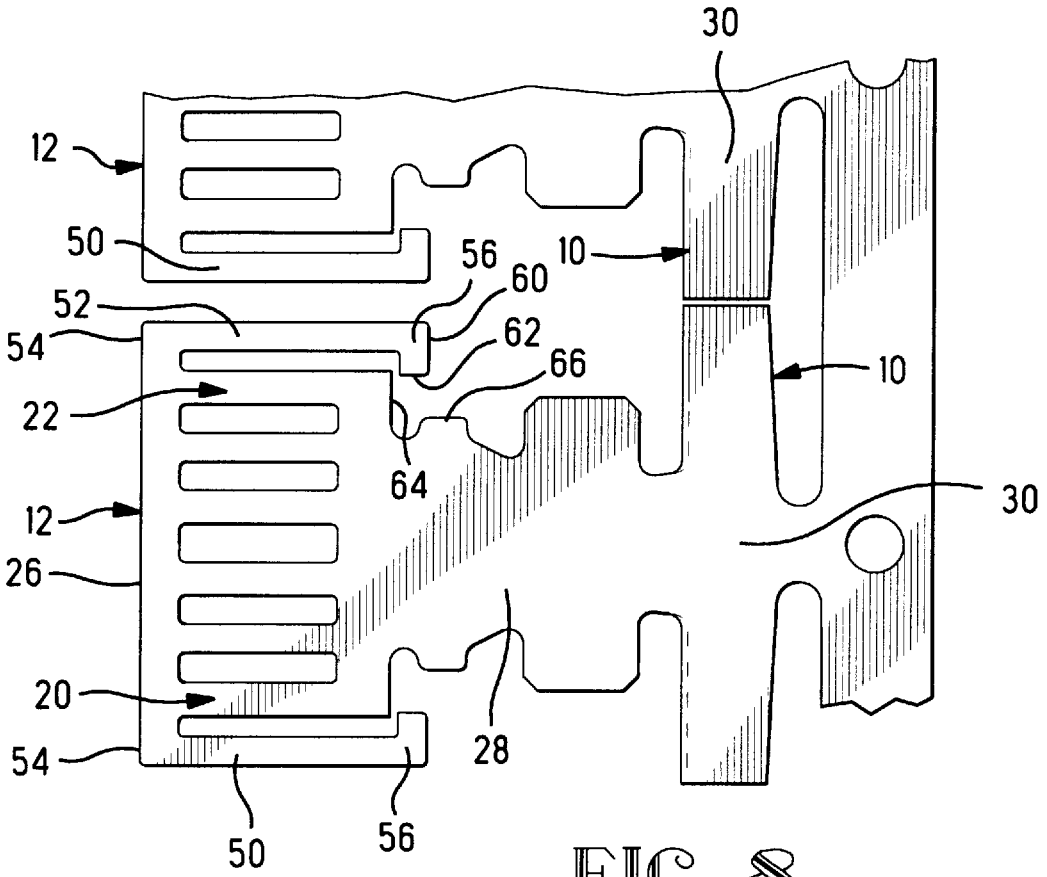
FIG. 8 is a plan view of a blank of the contact of FIGS. 1 to 7 prior to forming.

Contact 10 is designed to be stamped from an integral blank as shown in FIG. 8. All portions of the eventually formed contact may be stamped from the same metal between adjacent contact sites along a carrier strip, and also make use of material otherwise discarded in the stamping process. Latching arms 50,52 are seen positioned along opposed side edges of the blank outwardly from the top wall sections 20,22 having contact spring arms 34,36.

Referring now to FIGS. 9 and 10, a second embodiment of contact member 100 has a socket contact section 102 forwardly of connection section 104, which is shown to remain joined to a carrier strip 106 as is conventional during stamping and forming of many contacts from strips or blanks of metal closely adjacent other such contacts to minimize waste of material. In this embodiment, a single latching arm 108 is utilized and is shown to be like latching arm 52 of FIGS. 1 to 6, thus being usable with a housing passageway similar to that of FIGS. 2 to 6 and being retained in the passageway in like manner. Free end 110 of latching arm 108 is shown to include a tab 112 depending therefrom between the side walls of the socket contact section 102 just rearwardly of a top wall section trailing end portion 114, similarly to contact 10 of FIGS. 1 to 8. Preferably, an end portion 116 of tab 112 extends through an aperture 118 through bottom wall 120, so that the latching arm free end is positively captured by the contact for inherent antioverstress protection, again similarly to contact 10 of FIGS. 1 to 8.

In FIG. 11, a third embodiment of contact member 200 is shown to have a socket contact section 202. A pair of latching arms 204,206 are provided extending to free ends 208 that conclude forwardly of trailing top wall portions 210, for use in a housing passageway (not shown) similar to that shown in FIGS. 2 to 6 but providing latching ledges farther forwardly along the passageway.

The fourth embodiment of contact member 300 in FIGS. 12 to 14 is somewhat different from the embodiments of FIGS. 1 to 11. A socket contact section 302 again provides top wall sections 304,306 similar to top wall sections 20,22 of contact member 10 of FIG. 1, and a pair of contact spring arms 308,310 joined to leading end portions 312,314 and trailing end portions 316,318 thereof. A single latching arm 320 is defined that is joined at a leading end 322 to leading end portion 312 of top wall section 304, being stamped from the same portion of the blank as contact spring arm 308 to coextend adjacent thereto.

Latching arm 320 extends rearwardly past trailing end portions 316,318 of top wall sections 304,306 to a free end 324. Preferably the latching arm 320 passes beneath trailing end portion 318 (shown partially broken away in FIG. 12) and thus is captured by the contact for inherent antioverstress protection. Free end 324 is shown to include lateral or side portions 326 that are bent to coextend upwardly or away from contact-receiving channel 328 rearwardly of the rear edges of trailing end portions 316,318. Latching surfaces 330 are the rearwardly facing edges of side portions 326 that, like the rearwardly facing edges of free ends 56 of latching arms 50,52 of contact member 10 of FIGS. 1 to 8, are oriented to extend away from the contact-receiving channel of the socket contact section. It is preferred that side portions 326 be provided with angled forwardly facing surfaces 332 to facilitate contact insertion, and also be provided with rearwardly facing latching surfaces 330 that are angled slightly downwardly toward contact-receiving passageway 328 and bottom wall of the contact member. It is seen that vertical forward edges 334 of side portions 326 are adjacent rearward edges 336 of trailing end portion 318 of top wall section 306, thus providing the contact with its own inherent protection against collapse of the latching arm under substantial stress.

FIG. 13 illustrates a housing 340 having a pair of passageways 342 each adapted for use with a respective contact member 300, and together the housing and contacts define an electrical connector. One of contact members 300 is shown partially inserted into the lower passageway 342, and the other has been fully inserted into the upper one. A vertically constricted central passageway portion 344 is disposed between forward passageway portion 346 and rearward passageway portion 348, and latching ledges 350 are defined on the forwardly facing surfaces of the constriction. Tapered surfaces 352 preferably are used at the rearward end of central passageway portion for urging the socket contact section to the center for passage therethrough, and also serve to bear against angled surfaces 332 of latching arm side portions 326 at free end 324 to initiate deflection of latching arm 320 downwardly into contact-receiving channel 328 to pass through the central passageway portion.

Latching ledges 350 are preferably angled to form an undercut. As can be seen with respect to the fully inserted upper one of contact members 300, the angled latching ledge cooperates with the complementarily angled latching surfaces 330 of the latch arm 320 to prevent inadvertent deflection of the latch arm into the contact-receiving channel and thus prevent inadvertent delatching from the housing when substantial stress is applied to the wire to which the contact is terminated. Also, in FIG. 13, it may be seen that latching ledges 350 are formed along both of the relative top and bottom walls of the passageway to latch with the latching arms of a contact member 300 inserted in either the upright orientation shown or an inverted orientation.

Contact 300 is stamped from an integral blank, as seen in FIG. 14; latching arm 320 is defined along a side edge portion of the blank outwardly from the portion defining top wall section 304 with its contact spring arm 308. Top wall section 306 is shown to include a lengthened trailing end portion 318 to pass over the latching arm upon forming of the contact.

It can be seen that several advantages arise from the present invention: the latching mechanism is placed on a latching arm that is elongate so that it is easily deflected during contact insertion to minimize resistance to insertion; the latching arm is easily restrained against deflection after full insertion into a housing passageway of complementary shape; and preferably the contact itself includes inherent antioverstress protection, resulting in enhanced contact retention force within the housing.

Other variations and modifications to the specific examples disclosed herein, may occur to the artisan that are within the spirit of the invention and the scope of the claims.

What is claimed is:

1. An electrical contact of the type having a socket contact section at an end thereof adapted to mate with a male contact, and being insertable into a passageway of a housing and latchable therewithin, comprising:

a member stamped and formed to have first and second ends, a latching arm extending rearwardly from said first end to a rearwardly facing latching surface that upon full insertion seats against a ledge along an adjacent wall of said passageway to latchingly secure said member in said passageway; and said member further includes a socket contact section at said first end and a connection section at said second end, said socket contact section having in cross-section a bottom wall, opposed side walls and a top wall altogether defining a contact-receiving channel extending rearwardly from a forward end, with said side walls extending upwardly from said bottom wall and said top wall defined by sections extending toward each other from upper edges of said side walls; and said socket contact section further includes a spring arm defined along each said top wall section with leading and trailing ends thereof joined to forward and rearward portions of a respective said top wall section, and said latching arm extends rearwardly from a said forward end portion of one of said top wall sections adjacent to a said spring arm of said one of said top wall sections, and further extends past a trailing end portion of one of said top wall sections to a free end, and said free end includes at least one portion extending outwardly from said contact-receiving channel defining said rearwardly facing latching surface, all such that said latching arm is deflectable into said contact-receiving channel during insertion into said passageway of said housing.

2. The contact as set forth in claim 1 wherein a forwardly facing edge of each said outwardly extending portion of said free end is chamfered to facilitate deflection during initial stages thereof by a said constriction of said housing passageway.

3. The contact as set forth in claim 1 wherein said rearwardly facing edge of each said outwardly extending portion of said free end is angled rearwardly extending away from said contact-receiving channel to resist delatching by being engageable with a complementarily angled ledge of said housing passageway.

4. The contact as set forth in claim 1 wherein a rearward edge of a said trailing end portion of a said top wall section is forwardly of a forward edge of each said outwardly extending portion of said free end, to prevent buckling of said latching arm forwardly under stress.

5. The contact as set forth in claim 1 wherein said latching arm passes beneath one of said trailing end portions of a said top wall section, and said free end thereof is rearwardly therefrom.

6. An electrical connector comprising:

a housing including at least one passageway extending from an insertion face to a mating face, said passageway including a passageway constriction rearwardly of a forwardly facing latching ledge defined along a sidewall of said housing passageway; and a contact insertable into said at least one passageway from said insertion face toward said mating face for a socket contact section at one end thereof to be exposed at said mating face to receive a mating contact into a contact-receiving channel of said socket contact section extending rearwardly from a forward end thereof, and further including a connecting section at another end thereof for connection to an electrical conductor;

a latching arm extending rearwardly to a free end from a leading portion of a respective top wall section adjacent said forward end of said socket contact section, with at least a trailing edge of said free end of said at least one latching arm oriented to extend outwardly from said contact-receiving channel, said at least one latching arm being deflectable during insertion into said housing passageway from said insertion face thereof to pass along an axially extending wall of a passageway constriction rearwardly of a forwardly facing latching ledge defined along a sidewall of said housing passageway, until said trailing edge passes said latching ledge whereafter said latching arm resiles and said trailing edge seats against said ledge to latchingly secure said member in said passageway, said socket contact section having in cross-section a bottom wall, opposed side walls and a top wall altogether defining said contact-receiving channel, with said side walls extending upwardly from said bottom wall and said top wall defined by sections extending toward each other from upper edges of said side walls, said socket contact section further including a spring arm defined along each said top wall section with leading and trailing ends thereof joined to forward and rearward portions of a respective said top wall section, and said latching arm extending adjacent to at least one said spring, and further extends beneath and past a rearward end portion of one of said top wall sections to said free end, and said free end includes at least one portion extending outwardly from said contact-receiving channel defining said rearwardly facing latching surface, all such that said latching arm is deflectable into said contact-receiving channel during contact insertion into said passageway of said housing.

7. The connector as set forth in claim 6 wherein said rearwardly facing edge of each said outwardly extending portion of said free end is angled rearwardly extending away from said contact-receiving channel, and said latching ledge is undercut to be complementarily angled to correspond therewith, with said angled rearwardly facing edge and said angled latching ledge cooperate to resist delatching.

8. The connector as set forth in claim 7 wherein said housing passageway includes a pair of said latching ledges disposed on opposed walls thereof, facilitating latching with said latching arm when said contact is either in a relative upright or inverted orientation within said passageway.

* * * * *